US009474665B1

(12) United States Patent
Chan

(10) Patent No.: US 9,474,665 B1
(45) Date of Patent: Oct. 25, 2016

(54) DETACHABLE ELECTRIC WHEELCHAIR

(71) Applicant: Shu-Chen Chan, Changhua County (TW)

(72) Inventor: Shu-Chen Chan, Changhua County (TW)

( * ) Notice: Subject to any disclaimer, the term of this patent is extended or adjusted under 35 U.S.C. 154(b) by 0 days.

(21) Appl. No.: 14/878,900

(22) Filed: Oct. 8, 2015

(51) Int. Cl.
*A61G 5/04* (2013.01)
*A61G 5/08* (2006.01)
*A61G 5/12* (2006.01)

(52) U.S. Cl.
CPC ..... *A61G 5/047* (2013.01); *A61G 5/08* (2013.01); *A61G 2005/122* (2013.01); *A61G 2005/125* (2013.01); *A61G 2005/128* (2013.01)

(58) Field of Classification Search
CPC ..... A61G 5/04; A61G 5/041; A61G 5/045; A61G 5/047
See application file for complete search history.

(56) References Cited

U.S. PATENT DOCUMENTS 5,291,959 A * 3/1994 Malblanc ..... A61G 5/047 180/11
5,351,774 A * 10/1994 Okamoto ..... A61G 5/047 180/11
6,769,503 B2 * 8/2004 Cheng ..... B60R 16/04 180/65.1
2012/0279789 A1 * 11/2012 Brill ..... A61G 5/047 180/6.5

* cited by examiner

*Primary Examiner* — Kevin Hurley
(74) *Attorney, Agent, or Firm* — Ming Chow; Sinorica, LLC

(57) ABSTRACT

A wheelchair has a chair, an electrical power device, a foot stand, and a control device. The chair has two arm rest frames, and each arm rest frame has a connection board. The electrical power device is detachably connected with the connection boards and has a holding frame, a driving device, and two rear wheels. The holding frame has two holding boards respectively connected with the connection boards by multiple securing assemblies. Each securing assembly has a holding sleeve, a connecting rod, a knob, and a spring. The holding sleeve has multiple abutting ribs. The connecting rod is mounted through the holding sleeve and has a first end and a second end selectively extending into one of the connecting holes defined in a corresponding connection board. The knob is mounted securely around the second end of the connecting rod and has multiple engaging grooves.

18 Claims, 14 Drawing Sheets

DETACHABLE ELECTRIC WHEELCHAIR

BACKGROUND OF THE INVENTION

1. Field of the Invention

The present invention relates to an electric wheelchair, and more particularly to a detachable and foldable electric wheelchair.

2. Description of Related Art

A wheelchair is applied to assist a person in need of mobility aid. A conventional wheelchair has two different types including a manual type and an electric type. The conventional electric wheelchair is driven by electric power and is convenient to transport people in need of mobility aid to desired locations. The conventional electric wheelchair comprises an electric power device having a motor and a battery. However, the electric power device of the conventional electric wheelchair has a heavy weight and is not easy to be detached or folded. Therefore, the conventional electric wheelchair can hardly be transported to another location by vehicles and is not convenient in use.

To overcome the shortcomings, the present invention tends to provide an electric wheelchair to mitigate or obviate the aforementioned problems.

SUMMARY OF THE INVENTION

The main objective of the invention is to provide an electric wheelchair that is detachable and foldable.

The electric wheelchair has a chair, an electrical power device, a foot stand, and a control device. The chair is foldable and has a seat, a back rest, two arm rest frames, two front wheels, and two pushing bars. The seat has two sides. The back rest is foldable, is connected with the seat, and has two sides. The arm rest frames are respectively connected securely with the sides of the seat. Each arm rest frame has a connection board provided with multiple connecting holes defined in the connection board. The front wheels are respectively mounted rotatably on the arm rest frames. The pushing bars are connected respectively with the arm rest frames and are located respectively at the sides of the back rest. The electrical power device is detachably connected with the chair between the arm rest frames and has a holding frame, a driving device, and two rear wheels. The holding frame is connected detachably with the arm rest frames and has two sides and two holding boards. The holding boards are mounted respectively on the sides of the holding frame and are respectively connected with the connection boards of the arm rest frames by multiple securing assemblies. Each securing assembly has a holding sleeve, a connecting rod, a knob, and a spring. The holding sleeve is mounted securely on the holding board on which the securing assembly is mounted and has multiple abutting ribs formed longitudinally on an outer surface of the holding sleeve. The connecting rod is mounted through the holding sleeve and has a first end and a second end selectively extending into one of the connecting holes in the connection board of a corresponding one of the arm rest frames. The knob is mounted securely around the second end of the connecting rod, is hollow, and has an inner surface and multiple engaging protrusions formed on and protruding from the inner surface to define multiple engaging grooves between the engaging protrusions. The abutting ribs on the holding sleeve are selectively mounted respectively in the engaging grooves. The spring is mounted around the connecting rod and has two ends abutting respectively on the connecting rod and the holding sleeve. The driving device is mounted on the holding frame. The two rear wheels are mounted rotatably on the holding frame and are driven by the driving device. The foot stand is mounted detachably on the arm rest frames. The control device is detachably mounted on one of the arm rest frames.

Other objects, advantages and novel features of the invention will become more apparent from the following detailed description when taken in conjunction with the accompanying drawings.

DETAILED DESCRIPTION OF PREFERRED EMBODIMENT

Figure 1:
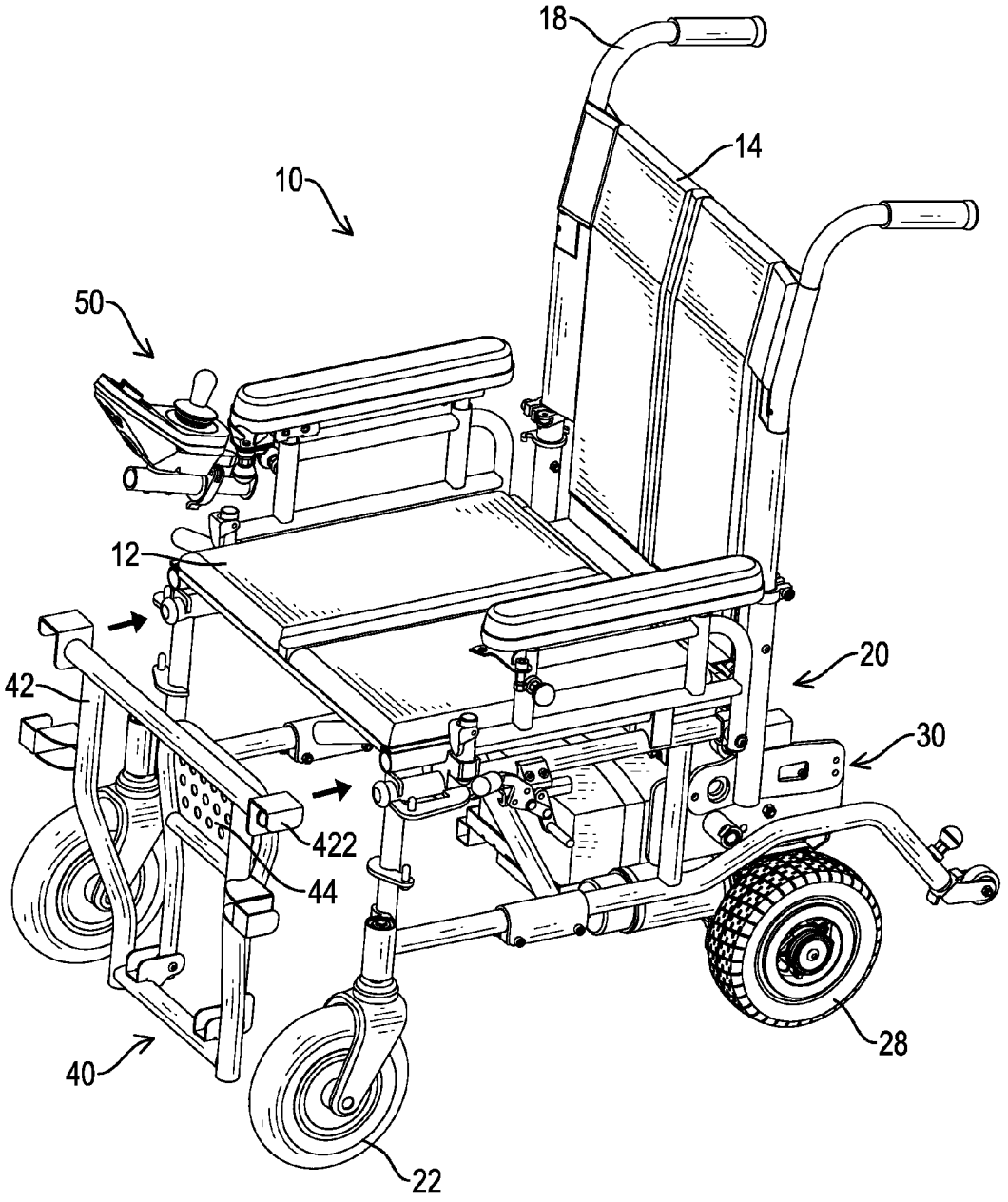
FIG. 1 is a partially exploded perspective view of an electric wheelchair in accordance with the present invention.
Figure 2:
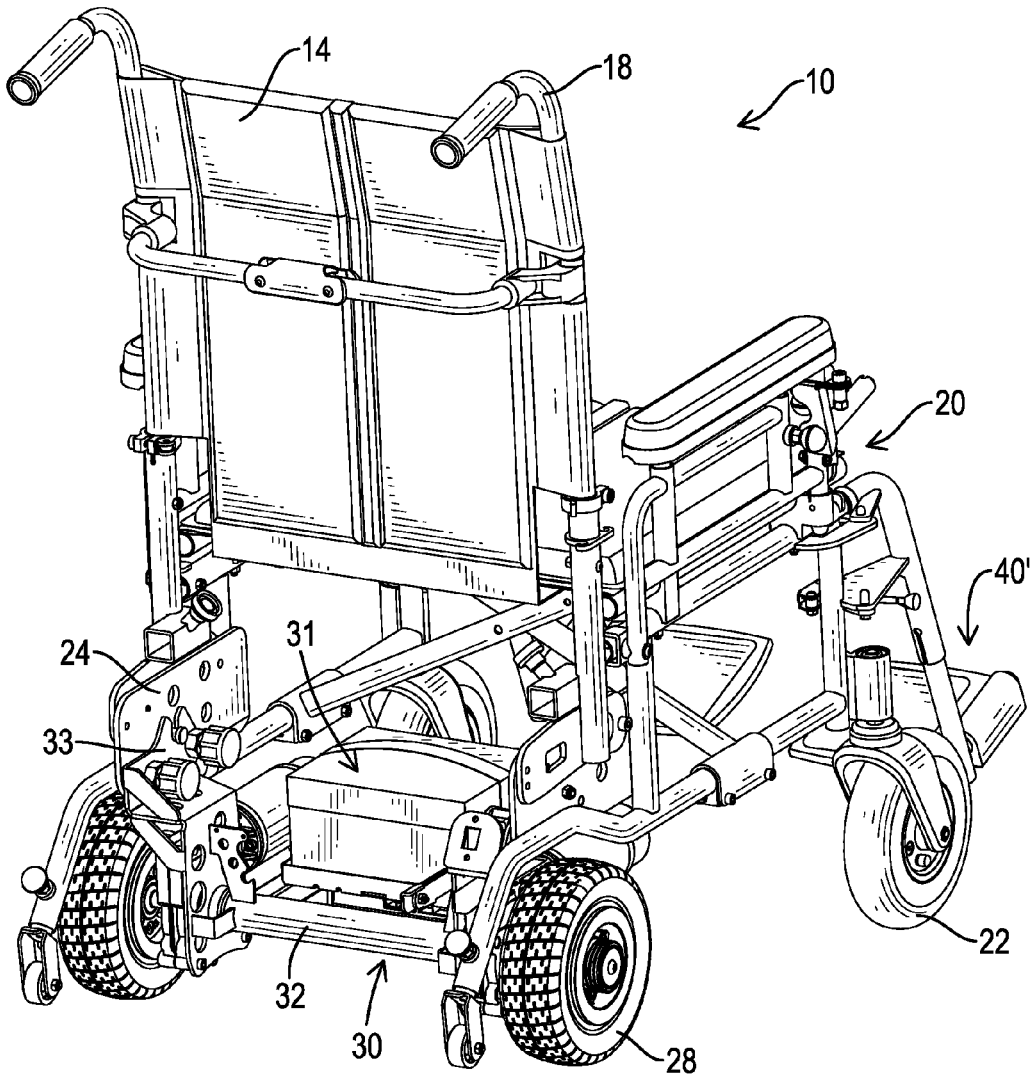
FIG. 2 is a perspective view of the electric wheelchair in FIG. 1.

With reference to FIGS. 1 and 2, an electric wheelchair in accordance with the present invention comprises a chair 10, an electrical power device 30, a foot stand 40, and a control device 50. The chair 10 is foldable and comprises a seat 12, a back rest 14, two arm rest frames 20, two front wheels 22, and two pushing bars 18. The seat 12 is foldable and has two sides. The back rest 14 is foldable, is connected with the seat 12, and has two sides. The arm rest frames 20 are respectively connected securely with the sides of the seat 12. Each arm rest frame 20 is composed of multiple rods and has an arm rest to allow a hand of a user to put on the arm rest and a connection board 24. The connection board 24 is provided with multiple connecting holes 242 defined in the connection board 24. The front wheels 22 are respectively mounted rotatably on the arm rest frames 20. The pushing bars 18 are connected respectively with the arm rest frames 20 and are located respectively at the sides of the back rest 14 to allow the wheelchair to be pushed to move by another person.

Figure 3:
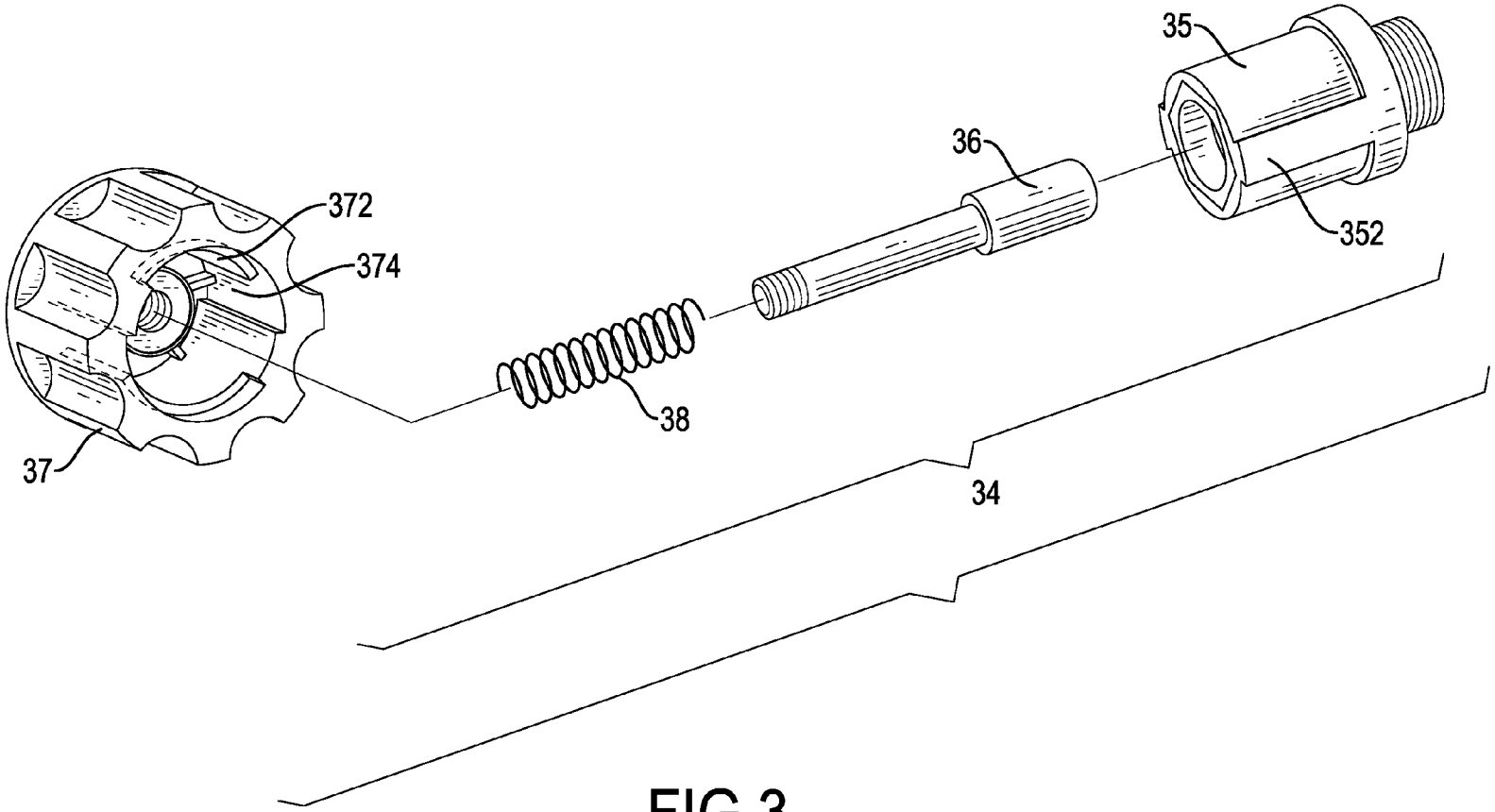
FIG. 3 is an exploded perspective view of a securing assembly of the electric wheelchair in FIG. 1.
Figure 4:
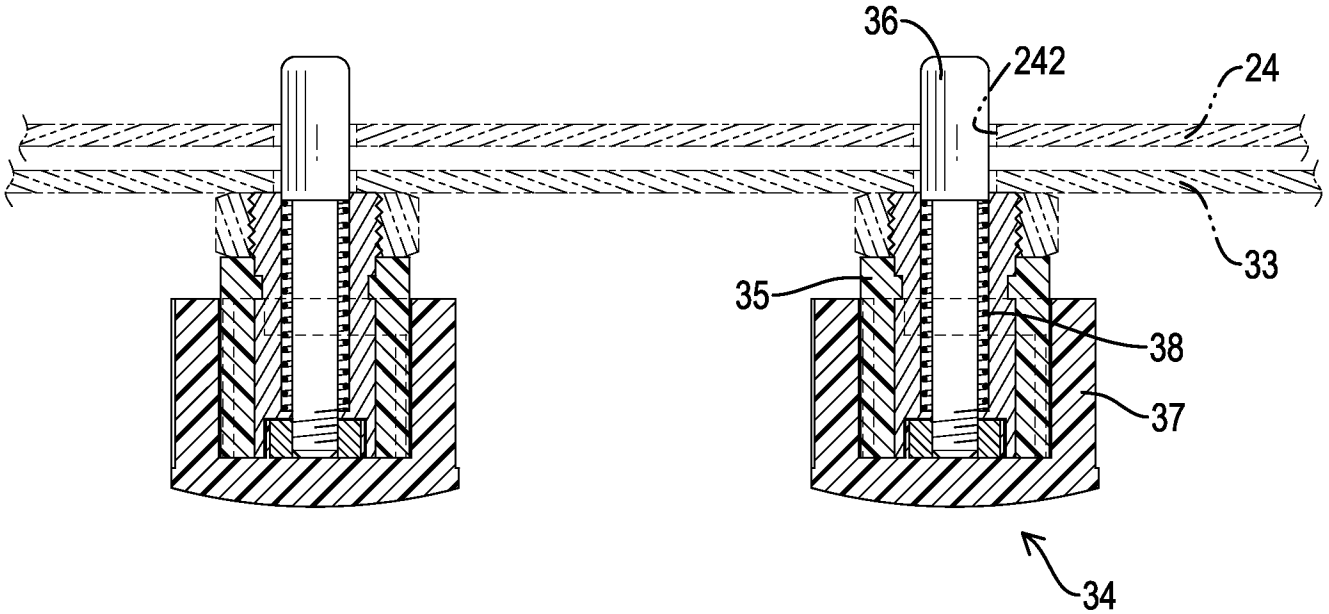
FIG. 4 is an enlarged top view in partial section of the connection board, the holding board and two securing assemblies of the electric wheelchair in FIG. 1.
Figure 5:
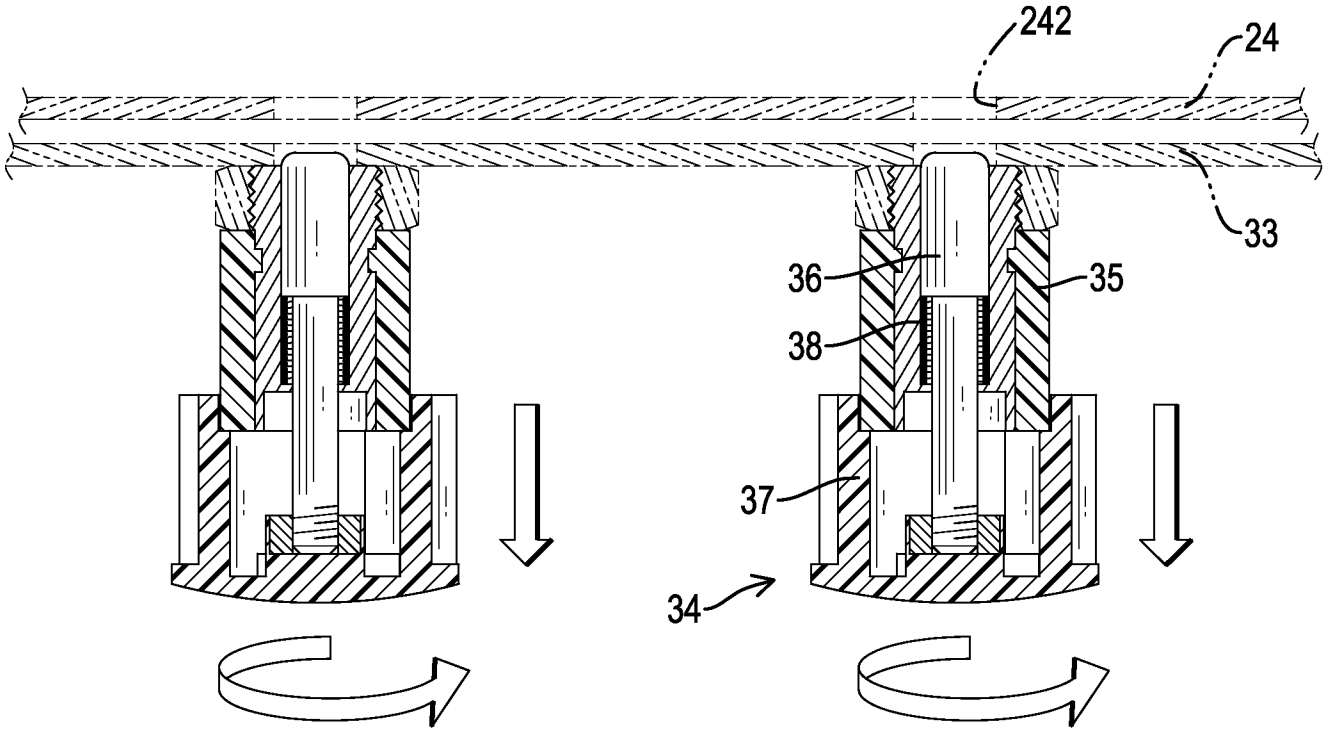
FIG. 5 is an operational top view in partial section of the connection board, the holding board and two securing assemblies of the electric wheelchair in FIG. 4.

The electrical power device 30 is detachably connected with the chair 10 between the arm rest frames 20 and comprises a holding frame 32, a driving device 31, and two rear wheels 28. The driving device 31 is mounted on the holding frame 32 and substantially comprises a motor and an electrical power source. The rear wheels 28 are mounted rotatably on the holding frame 20 and are driven by the driving device 31. The driving device 31 and the rear wheels 28 may be conventional, and detailed descriptions of the driving device 31 and the rear wheels 28 are omitted. With further reference to FIGS. 3 to 5, the holding frame 32 is connected detachably with the arm rest frames 20 and has two sides and two holding boards 33. The holding boards 33 are mounted respectively on the sides of the holding frame 32 and are respectively connected with the connection boards 24 of the arm rest frames 20 by multiple securing assemblies 34. Each securing assembly 34 comprises a holding sleeve 35, a connecting rod 36, a knob 37, and a spring 38. The holding sleeve 35 is mounted securely on the holding board 33 and has multiple abutting ribs 352 formed longitudinally on an outer surface of the holding sleeve 35. The connecting rod 36 is mounted through the holding sleeve 35 and has a first end and a second end selectively extending into one of the connecting holes 242 in the connection board 24 of a corresponding one of the arm rest frames 20. The knob 37 is hollow, is mounted securely around the second end of the connecting rod 36, and has an inner surface and multiple engaging protrusions 372. The engaging protrusions 372 are formed on and protrude from the inner surface of the knob 37 to define multiple engaging grooves 374 between the engaging protrusions 372. The abutting ribs 352 on the holding sleeve 35 are selectively mounted respectively in the engaging grooves 374. The spring 38 is mounted around the connecting rod 36 and has two ends abutting respectively on the connecting rod 36 and the holding sleeve 35 to provide a force to push the second end of the connecting rod 36 to extend into the corresponding connecting hole 242.

With the engagements between the second ends of the connecting rods 36 and the connecting holes 242, the holding boards 33 are connected securely with the connection boards 24. Thus, the electrical power device 30 is connected securely with the chair 10. Accordingly, the driving device 31 can drive the rear wheels 28 to rotate so as to move the electric wheelchair automatically with electrical power. With reference to FIG. 5, to disassemble the wheelchair, the knob 37 of each securing assembly 34 is pulled to disengage the second end of the connecting rod 36 from the corresponding connecting hole 242. At this time, the abutting ribs 352 on the holding sleeve 35 are also disengaged from the engaging grooves 374 in the knob 37 and the spring 38 is compressed. The knob 37 is then rotated to make the abutting ribs 352 on the sleeve 35 abut on ends of the engaging protrusions 372, such that the second end of the connecting rod 36 can be kept from protruding from the holding sleeve 35 into the corresponding connecting hole 242. Accordingly, the connecting rods 36 of the securing assemblies 34 are disengaged from the connecting holes 242 in the connection boards 24 in sequence. Consequently, the electrical power device 30 can be detached from the chair 10 to make the chair 10 foldable, such that the folded chair 10 and the removed electrical power device 30 can be put on a vehicle individually. Therefore, the electric wheelchair can be transported to another location for use by vehicles.

To attach the electrical power device 30 onto the chair 10, the holding boards 33 on the holding frame 32 are aligned with the connection boards 24 respectively to align the connecting rods 36 of the securing assemblies 34 respectively with the connecting holes 242 of the connection boards 24. The knobs 37 are then rotated in reverse, the abutting ribs 352 on the holding sleeves 35 leave the positions where the abutting ribs abut with the ends of the engaging protrusions 372 of the knob 37, and are aligned with the engaging grooves 374 of the knobs 37. Then, the connecting rods 36 are pushed to extend into the connecting holes 242 respectively with the forces provided by the springs 38. Accordingly, the electrical power device 30 is securely combined with the chair 10.

In addition, each connection board 24 has a positioning pin 244 formed on and protruding from the connection board 24. Each holding board 33 has a positioning recess 332 defined in the holding board 33 and selectively holding the positioning pin 244 of a corresponding one of the connection boards 24 inside. With the positioning pin 244 on each connection board 24 being held in the positioning recess 332 in the corresponding holding board 33, the connecting rods 36 on each holding board 33 can be actually aligned with the connecting holes 242 in the corresponding connection board 24. Therefore, the process of combining the electrical power device 30 with the chair 10 is easy and time-saving.

Figure 6:
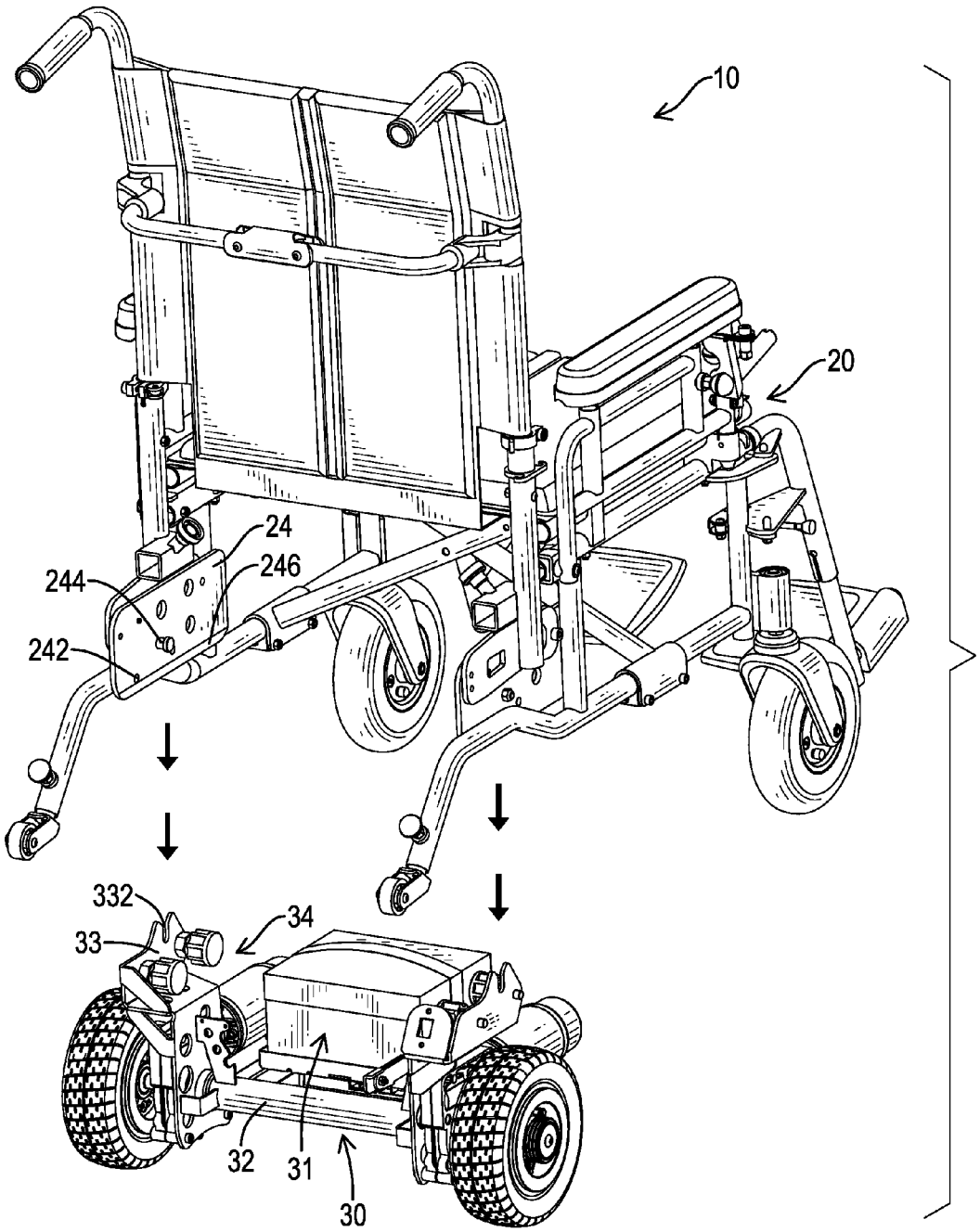
FIG. 6 is an exploded perspective view the electric wheelchair in FIG. 1 showing that the electrical power device is detached from the chair.

With reference to FIG. 6, the connection board 24 of each arm rest frame 20 further has an inclined guiding surface 246 formed on a bottom edge of the connection board 24. With the inclined guiding surface 246 on each connection board 24, the connecting rods 36 on the corresponding holding board 33 can be pushed to slightly retract relative into the holding sleeve 35. Consequently, the protruding connecting rod 36 from the holding sleeve 35 will not interfere with the combination process of the electrical power device 30.

Figure 14:
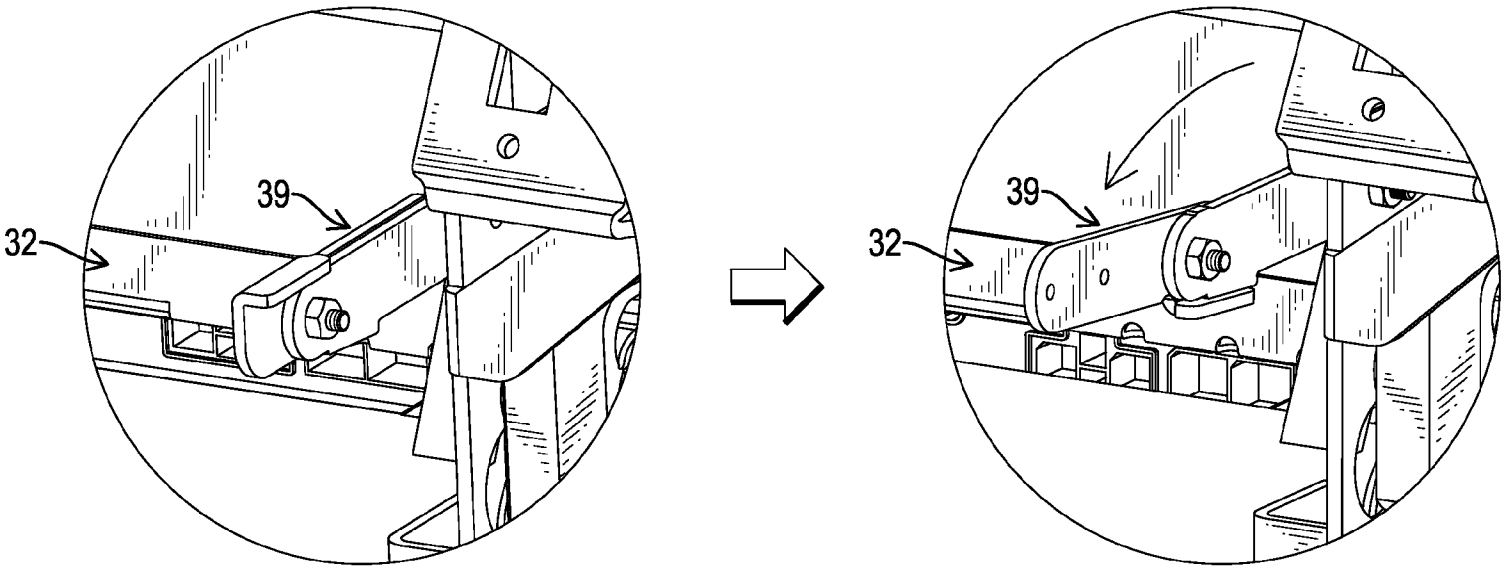
FIG. 14 shows enlarged operational perspective views of a stepping rod of the electrical power device of the electric wheelchair in FIG. 1.

With reference to FIGS. 6 and 14, the holding frame 32 of the electrical power device 30 further has a stepping rod 39 mounted pivotally on the holding frame 32. Because the driving device 31 is usually mounted on a front side of the holding frame 32, the holding frame 32 will incline forward due to gravity after the electrical power device 30 is detached from the chair 10. The inclined holding frame 32 will assist with the combination process of the electrical power device 30 with the chair 20. With the stepping rod 39, when the stepping rod 39 is pivoted and expanded, the user can step onto the stepping rod 39 to push the rear side of the holding frame 32 downward and to lift the front side of the holding frame 32 upward. Accordingly, the holding frame 32 with the driving device 31 will be at a balance position to allow the electrical power device 30 to be combined with the chair 10 conveniently.

Figure 7:
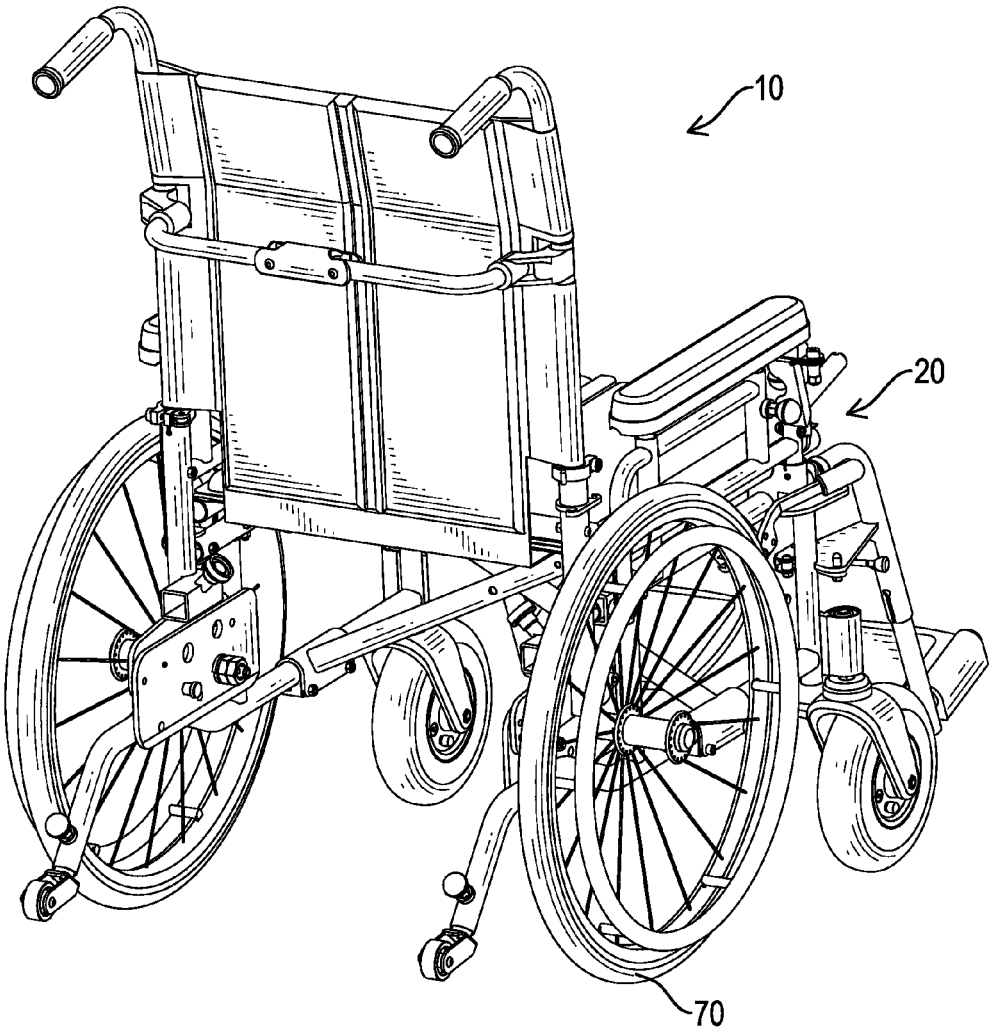
FIG. 7 is an operational perspective view of an alternative embodiment of the electric wheelchair in FIG. 1 showing that the chair is connected with two manual rear wheels.

With reference to FIG. 7, after the electrical power device 30 is detached from the chair 10, two manual rear wheels 70 can be assembled on the arm rest frames 20 respectively. Accordingly, the wheelchair can be applied as a manual type of wheelchair for different use demands, such that the wheelchair in accordance with the present invention is versatile in use.

Figure 8:
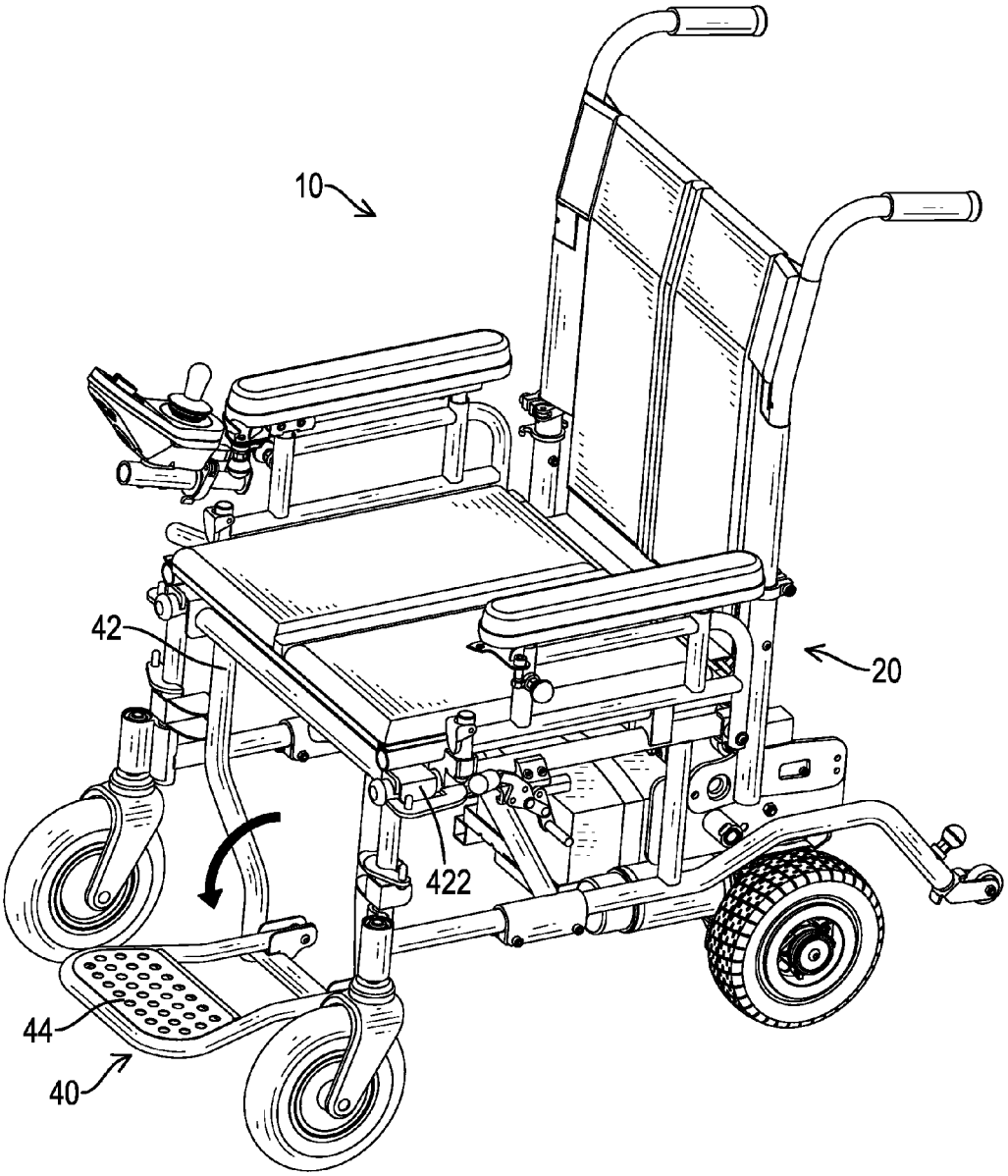
FIG. 8 is an operational perspective view of the electric wheelchair in FIG. 1 showing that the foot stand is expanded.
Figure 9A:
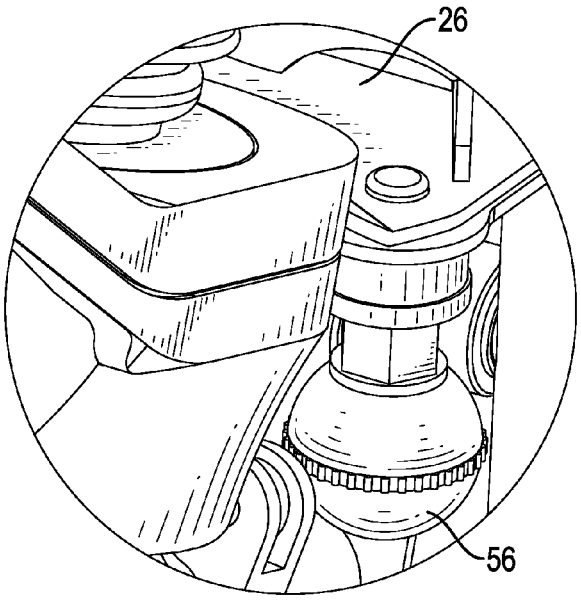
FIG. 9A is an enlarged perspective view of the control device of the electric wheelchair in FIG. 9.
Figure 9:
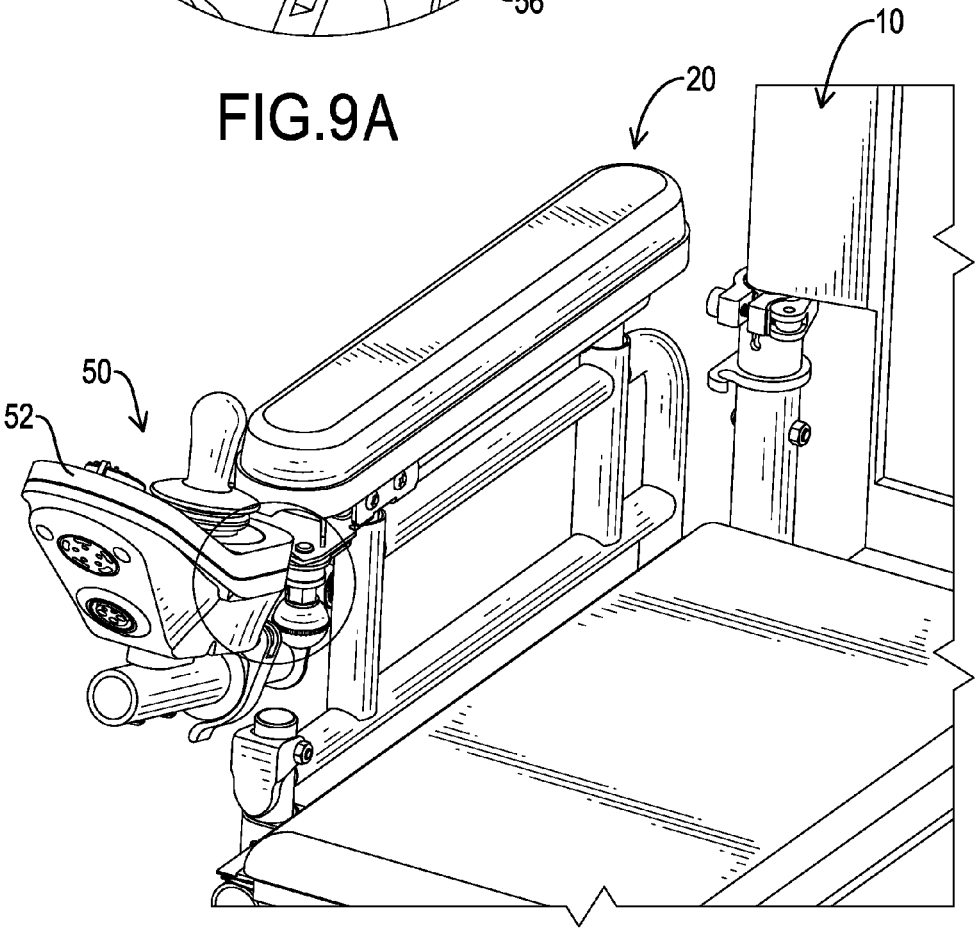
FIG. 9 is an enlarged perspective view of the control device of the electric wheelchair in FIG. 1.
Figure 10A:
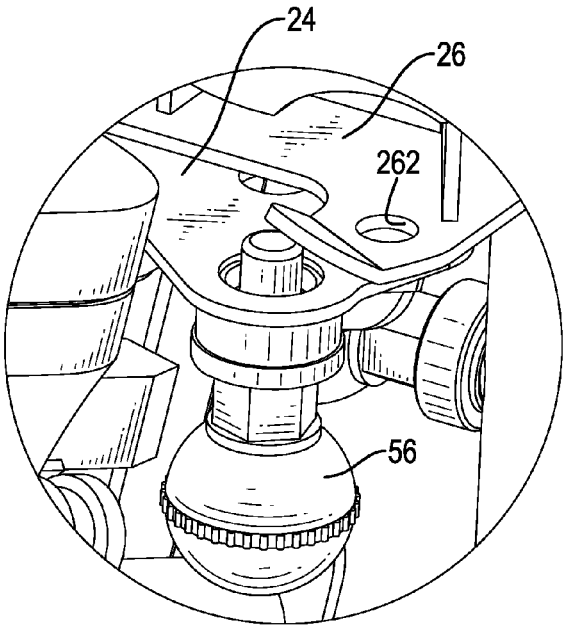
FIG. 10A is an enlarged perspective view of the control device of the electric wheelchair in FIG. 10.
Figure 10:
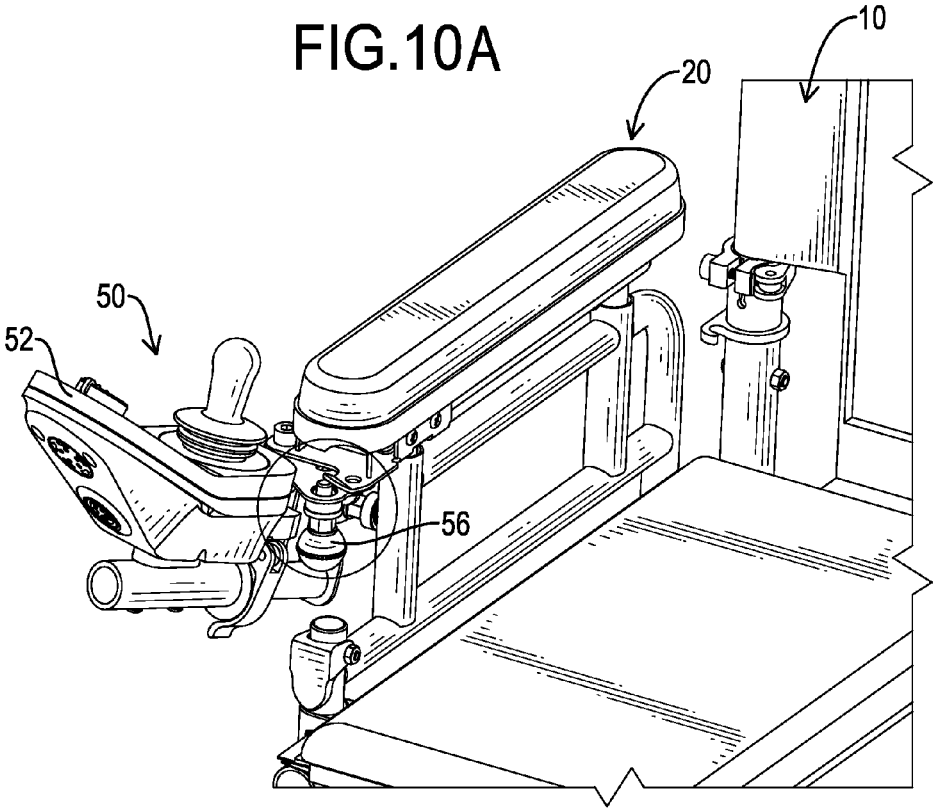
FIG. 10 is an operational perspective view of the control device of the electric wheelchair in FIG. 9.

With reference to FIGS. 1 and 8, the foot stand 40 is detachably mounted on front sides of the arm rest frames 20 and comprises a connecting frame 42 and a stepping board 44. The connecting frame 42 is connected detachably with the arm rest frames 20 and comprises two sides and multiple combination hooks 422 mounted on the sides of the connecting frame 42 and hooked onto the arm rest frames 20. The stepping board 44 may be a single board and is mounted pivotally on the connecting frame 42. Accordingly, the stepping board 42 can be pivoted and folded relative to the connecting frame 42 while the wheelchair is not in use such that the wheelchair can be conveniently folded or transported. When the stepping board 44 is pivoted downward relative to the connecting frame 42 to a using position, the user sitting on the chair 10 can put feet on the stepping board 44. With reference to FIG. 2, alternatively, the stepping board 44 may be a conventional dual-board type to fit with different needs of users.

Figure 11:
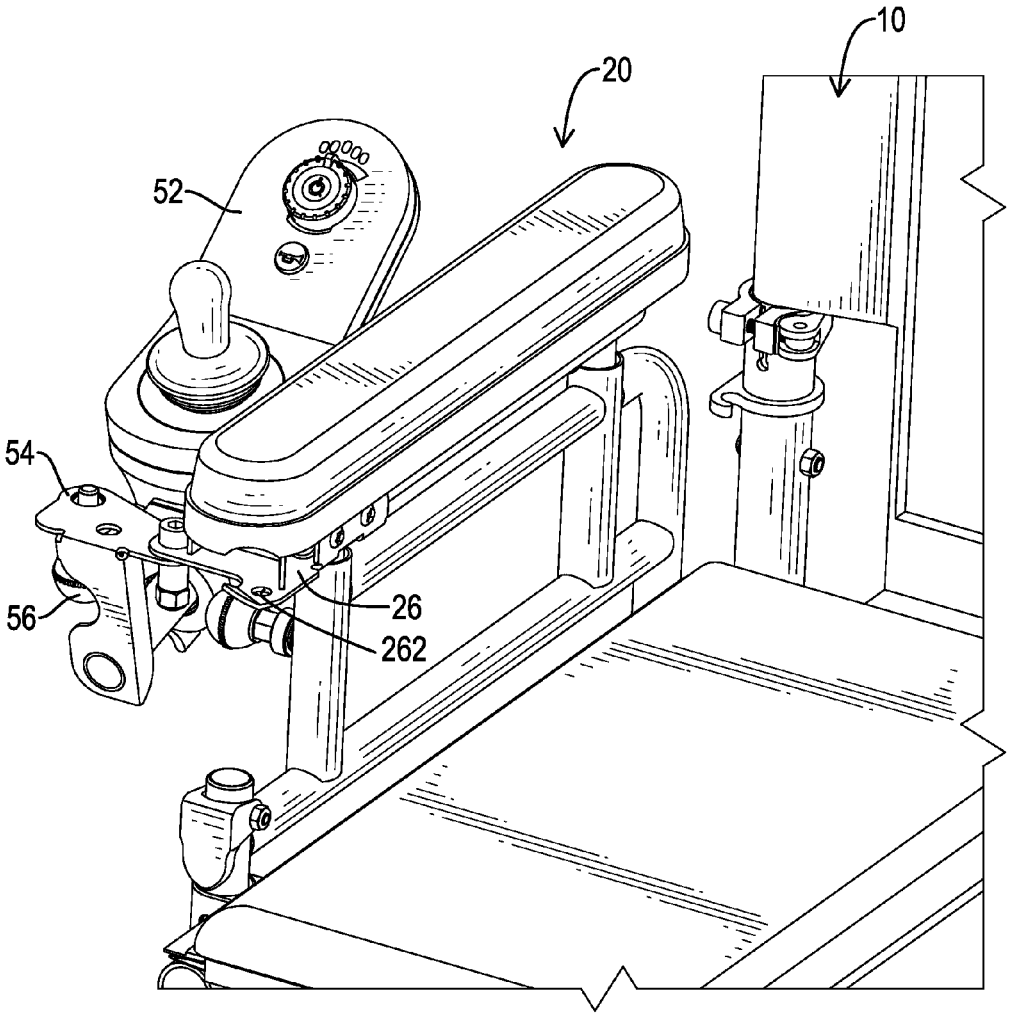
FIG. 11 is an operational perspective view of the control device of the electric wheelchair in FIG. 9 showing that the control device is pivoted to a side of the arm rest frame.

With reference to FIGS. 1 and 9 to 11, the control device 50 is detachably mounted on one of the arm rest frames 20, such that the user sitting on the chair 10 can control the electrical power device 20 via the control device 50 so as to turn the wheelchair on or off or to control the movement direction or the speed of the wheelchair. The control device 50 comprises a controller 52 and a pivotal arm 54. The pivotal arm 54 is connected detachably with the controller 52, is connected pivotally with a bracket board 26 of the arm rest frame 20 which is connected with the control device 50. The bracket board 26 has a positioning hole 262 defined in the bracket board 26. The pivotal arm 54 has a positioning pin 56 selectively extending into the positioning hole 262 in the bracket board 26. When the pivotal arm 54 is at a position where the positioning pin 56 extends into the positioning hole 262, the controller 52 is located in front of the chair 10, such that the user sitting on the chair 10 can conveniently operate the controller 52. Accordingly, the user can operate the control device 50 to control the wheelchair to move. After the positioning pin 56 is disengaged from the positioning hole 262, the pivotal arm 54 can be pivoted relative to the bracket board 26, such that the controller 52 can be moved to the side of the arm rest frame 20 as shown in FIG. 11 and the user can leave the chair 10 without being blocked by the controller 52.

Figure 12:
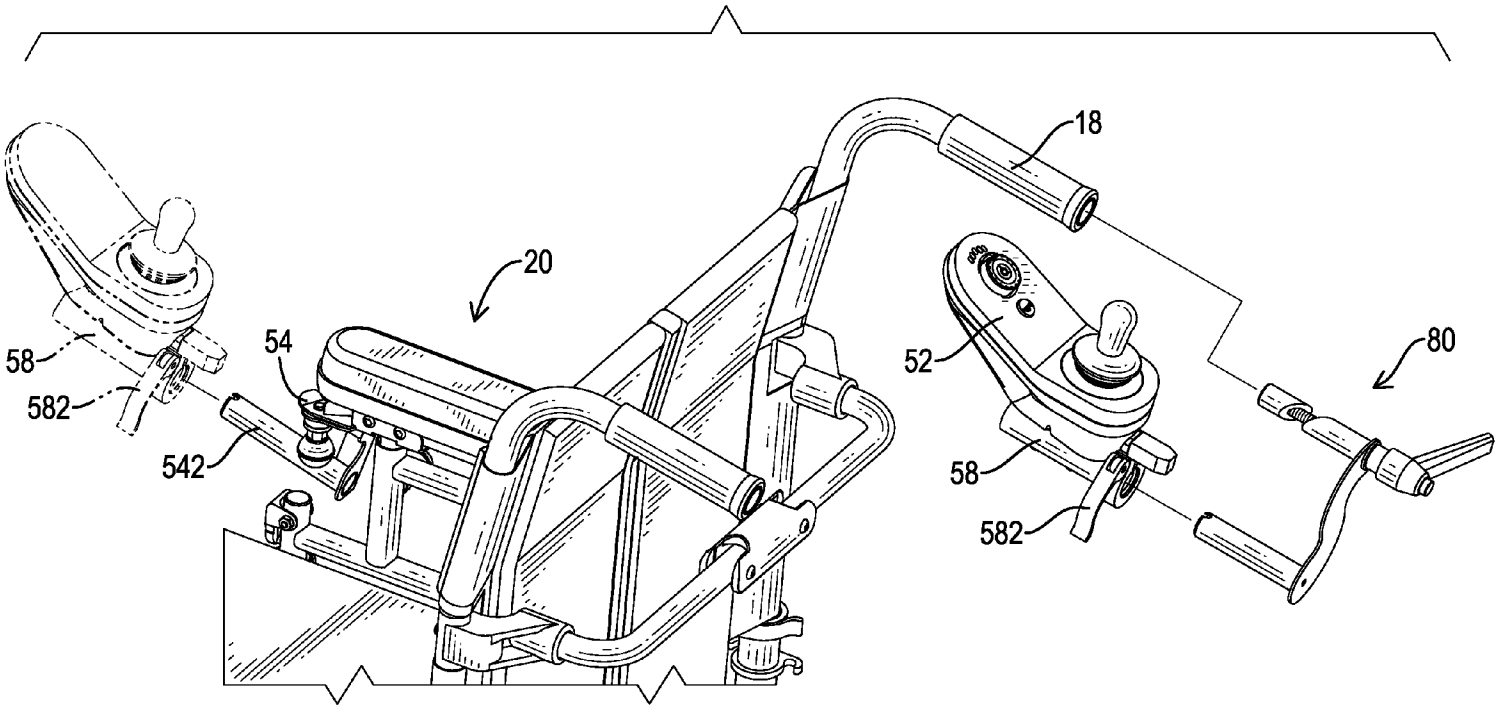
FIG. 12 is an enlarged partially exploded perspective view of the electric wheelchair in FIG. 1 showing that the control device is connected to a pushing bar with a fixing assembly.

With reference to FIG. 12, the pivotal arm 54 further has a fixing rod 542, and the controller 52 further has a holding tube 58 mounted on the controller 52 and mounted securely around the fixing rod 542 of the pivotal arm 54 with a quick-release clamp 582. With the quick-release clamp 582, the holding tube 58 is mounted securely around the fixing rod 542 and the controller 52 is connected securely with the pivotal arm 54. When the quick-release clamp 582 is released, the holding tube 58 can be detached from the fixing rod 542 and the controller 52 can be detached from the pivotal arm 54 and removed from the arm rest frame 20.

Figure 13:
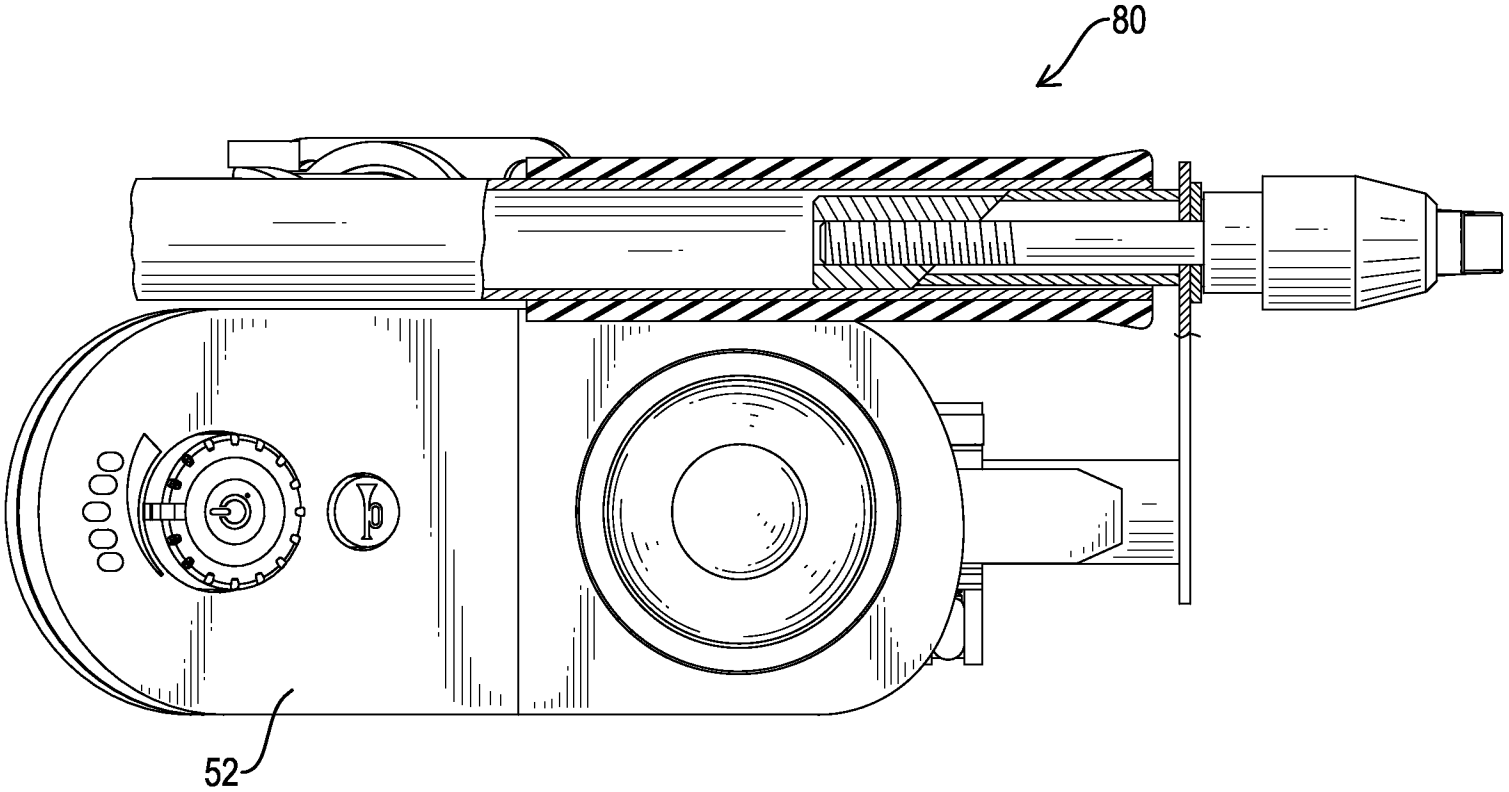
FIG. 13 is an enlarged top view in partial section of the control device and the fixing assembly of the electric wheelchair in FIG. 12.

With reference to FIGS. 1, 12, and 13, after the controller 52 is removed from the arm rest frame 20, the controller 52 can be attached to one of the pushing bars 18 with a fixing assembly 80. Accordingly, the controller 52 can be operated by another person to control the wheelchair.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electric wheelchair comprising:

a foldable chair comprising a seat being foldable and having two sides;

a back rest being foldable, connected with the seat, and having two sides;

two arm rest frames respectively connected securely with the sides of the seat, and each arm rest frame having a connection board provided with multiple connecting holes defined in the connection board;

two front wheels respectively mounted rotatably on the arm rest frames; and two pushing bars connected respectively with the arm rest frames and located respectively at the sides of the back rest;

an electrical power device detachably connected with the chair between the arm rest frames and comprising a holding frame connected detachably with the arm rest frames and having two sides;

two holding boards mounted respectively on the sides of the holding frame and respectively connected with the connection boards of the arm rest frames by multiple securing assemblies, and each securing assembly comprising a holding sleeve mounted securely on the holding board on which the securing assembly is mounted and having multiple abutting ribs formed longitudinally on an outer surface of the holding sleeve;

a connecting rod mounted through the holding sleeve and having a first end and a second end selectively extending into one of the connecting holes in the connection board of a corresponding one of the arm rest frames;

a knob mounted securely around the second end of the connecting rod, being hollow, and having an inner surface; and multiple engaging protrusions formed on and protruding from the inner surface of the knob to define multiple engaging grooves between the engaging protrusions, wherein the abutting ribs on the holding sleeve are selectively mounted respectively in the engaging grooves; and a spring mounted around the connecting rod and having two ends abutting respectively on the connecting rod and the holding sleeve;

a driving device mounted on the holding frame; and two rear wheels mounted rotatably on the holding frame and driven by the driving device;

a foot stand mounted detachably on the arm rest frames; and a control device detachably mounted on one of the arm rest frames.

2. The electric wheelchair as claimed in claim 1, wherein each connection board has a positioning pin formed on and protruding from the connection board; and each holding board has a positioning recess defined in the holding board and selectively holding the positioning pin of a corresponding one of the connection boards inside.

3. The electric wheelchair as claimed in claim 2, wherein the foot stand comprises a connecting frame connected detachably with the arm rest frames and comprising two sides; and multiple combination hooks mounted on the sides of the connecting frame and hooked onto the arm rest frames; and a stepping board being a single board and mounted pivotally on the connecting frame.

4. The electric wheelchair as claimed in claim 3, wherein the arm rest frame connected with the control device comprises a bracket board;

the bracket board has a positioning hole defined in the bracket board; and the control device comprises a controller; and a pivotal arm connected detachably with the controller, connected pivotally with the bracket board of the arm rest frame which is connected with the control device, and having a positioning pin selectively extending into the positioning hole in the bracket board.

5. The electric wheelchair as claimed in claim 4, wherein the pivotal arm further has a fixing rod; and the controller has a holding tube mounted on the controller and mounted securely around the fixing rod of the pivotal arm with a quick-release clamp.

6. The electric wheelchair as claimed in claim 5, wherein the connection board of each arm rest frame further has an inclined guiding surface formed on a bottom edge of the connection board.

7. The electric wheelchair as claimed in claim 6, wherein the holding frame of the electrical power device further has a stepping rod mounted pivotally on the holding frame.

8. The electric wheelchair as claimed in claim 1, wherein the foot stand comprises a connecting frame connected detachably with the arm rest frames and comprising two sides; and multiple combination hooks mounted on the sides of the connecting frame and hooked onto of the arm rest frames; and a stepping board being a single board and mounted pivotally on the connecting frame.

9. The electric wheelchair as claimed in claim 8, wherein the arm rest frame connected with the control device comprises a bracket board;

the bracket board has a positioning hole defined in the bracket board; and the control device comprises a controller; and a pivotal arm connected detachably with the controller, connected pivotally with the bracket board of the arm rest frame which is connected with the control device, and having a positioning pin selectively extending into the positioning hole in the bracket board.

10. The electric wheelchair as claimed in claim 9, wherein the pivotal arm further has a fixing rod; and the controller has a holding tube mounted on the controller and mounted securely around the fixing rod of the pivotal arm with a quick-release clamp.

11. The electric wheelchair as claimed in claim 10, wherein the connection board of each arm rest frame further has an inclined guiding surface formed on a bottom edge of the connection board.

12. The electric wheelchair as claimed in claim 11, wherein the holding frame of the electrical power device further has a stepping rod mounted pivotally on the holding frame.

13. The electric wheelchair as claimed in claim 1, wherein the arm rest frame connected with the control device comprises a bracket board;

the bracket board has a positioning hole defined in the bracket board; and the control device comprises a controller; and a pivotal arm connected detachably with the controller, connected pivotally with the bracket board of the arm rest frame which is connected with the control device, and having a positioning pin selectively extending into the positioning hole in the bracket board.

14. The electric wheelchair as claimed in claim 13, wherein the pivotal arm further has a fixing rod; and the controller has a holding tube mounted on the controller and mounted securely around the fixing rod of the pivotal arm with a quick-release clamp.

15. The electric wheelchair as claimed in claim 14, wherein the connection board of each arm rest frame further has an inclined guiding surface formed on a bottom edge of the connection board.

16. The electric wheelchair as claimed in claim 15, wherein the holding frame of the electrical power device further has a stepping rod mounted pivotally on the holding frame.

17. The electric wheelchair as claimed in claim 1, wherein the connection board of each arm rest frame further has an inclined guiding surface formed on a bottom edge of the connection board.

18. The electric wheelchair as claimed in claim 1, wherein the holding frame of the electrical power device further has a stepping rod mounted pivotally on the holding frame.

* * * * *